US010206494B1

(12) United States Patent
Gretscher

(10) Patent No.: US 10,206,494 B1
(45) Date of Patent: Feb. 19, 2019

(54) TABLE FRAME FOR A TABLE

(71) Applicant: KONRAD MERKT GmbH, Spaichingen (DE)

(72) Inventor: Juergen Gretscher, Dornhan (DE)

(73) Assignee: KONRAD MERKT GMBH, Spaichingen (DE)

( * ) Notice: Subject to any disclaimer, the term of this patent is extended or adjusted under 35 U.S.C. 154(b) by 0 days.

(21) Appl. No.: 15/814,363

(22) Filed: Nov. 15, 2017

(30) Foreign Application Priority Data

Aug. 15, 2017 (DE) ..... 10 2017 118 562

(51) Int. Cl.
*A47B 3/08* (2006.01)

(52) U.S. Cl.
CPC .... *A47B 3/0818* (2013.01); *A47B 2200/0036* (2013.01)

(58) Field of Classification Search
CPC ..... A47B 3/0818; A47B 3/083; A47B 27/14; A47B 2200/0036
See application file for complete search history.

(56) References Cited

U.S. PATENT DOCUMENTS 6,637,352 B1 * 10/2003 Thode ..... A47B 3/08 108/115
2010/0258042 A1 * 10/2010 Rutz ..... A47B 3/0818 108/115

(Continued)

FOREIGN PATENT DOCUMENTS

DE 20 2007 002 775 U1 5/2007
FR 3 021 852 12/2015

*Primary Examiner* — Daniel J Rohrhoff
(74) *Attorney, Agent, or Firm* — Breneman & Georges

(57) ABSTRACT

Proposed is a table frame for a table comprising a tabletop (1), wherein at least one support device (7) for supporting the tabletop (1) is provided, wherein the support device (7) comprises at least one support element (7) having a longitudinal axis (14), wherein at least one pivoting unit (13), having at least one pivot axis (11), for pivoting the support device (7) is provided such that the support device (7) is pivotable between a first, substantially horizontally arranged table position and a second, raised table position, wherein a base frame (2), comprising at least one crossmember element (9) oriented substantially parallel to the pivot axis (11), for supporting the pivotable support device (7) is provided, wherein at least one first fixing unit (13) for fixing the support device (7) in the first, substantially horizontally arranged table position is provided, wherein at least one second fixing unit (33) for fixing the support device (7) in the second, raised table position is provided, wherein at least the first fixing unit (13) comprises at least one first fixing element (12) that is adjustable relative to a second fixing element (16), wherein at least one actuating unit (12, 17, 31), adjustable substantially in the direction of the longitudinal axis (14) of the support element (7), for actuating the first fixing element (12) of the first fixing unit (13) is provided, said table frame meeting requirements in terms of stability, cost-effectiveness and convenience to a high degree and having in particular a long lifetime. This is achieved according to the invention in that the second fixing element (16) is arranged, as a second fixing element (16) formed separately from the base frame (2), so as to be fixedly connectable to the base frame (2).

18 Claims, 4 Drawing Sheets

(56) References Cited

U.S. PATENT DOCUMENTS

Figure 1:
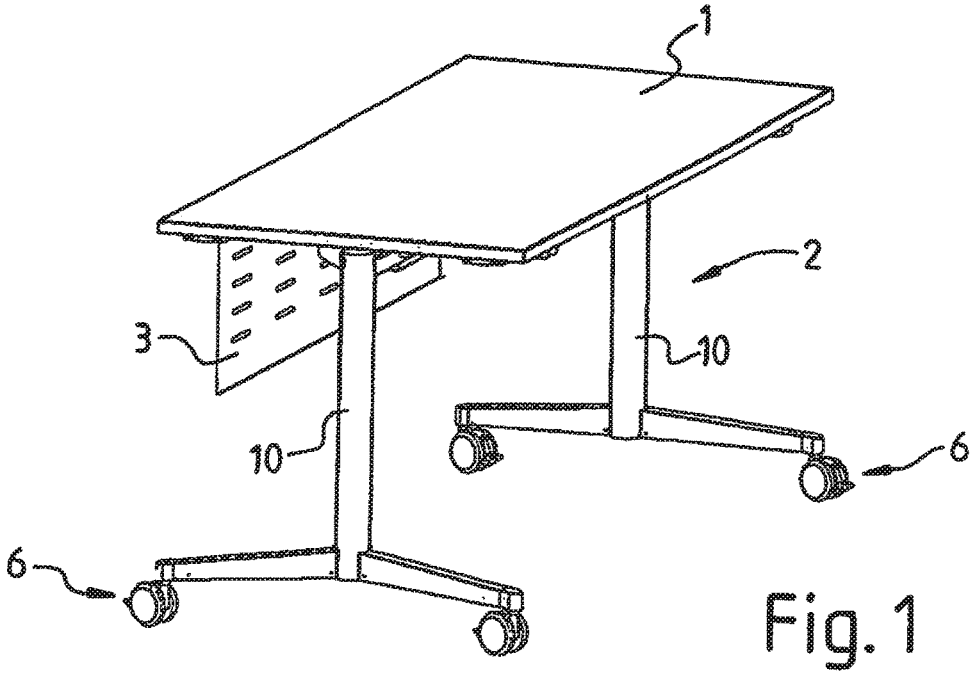

| | | | | |
|---|---|---|---|---|
| 2011/0017107 | A1* | 1/2011 | Ko | A47B 3/0818 108/64 |
| 2012/0204766 | A1* | 8/2012 | Elliott | A47B 3/002 108/50.11 |
| 2013/0284076 | A1* | 10/2013 | Okuda | A47B 3/08 108/115 |
| 2014/0026788 | A1* | 1/2014 | Kallio, III | A47B 13/081 108/6 |
| 2015/0182016 | A1* | 7/2015 | Rivera | F16B 2/185 108/123 |
| 2015/0223600 | A1* | 8/2015 | Pan | A47B 41/02 108/91 |
| 2016/0309888 | A1* | 10/2016 | Krusin | A47B 3/0809 |

* cited by examiner

TABLE FRAME FOR A TABLE

The invention relates to a table frame for a table according to the preamble of claim 1.

PRIOR ART

To date, a wide variety of tables and table frames thereof are already common. In addition to unalterable tables or height-adjustable tables and table frames, folding tables and tilting tables are also common. In the two last-mentioned table types, a position with a horizontal or levelly arranged tabletop and a position with a raised or usually (almost) vertical tabletop are possible, such that the table can be stored or transported for example in a space-saving manner or a plurality of tilted-up tables can be nested in one another. This is advantageous, inter alia, for uses of a table in the catering sector or as conference tables, etc.

The documents FR 30 21 852 A1 and DE 20 2007 002 775 U1 already disclose for example tilting tables, wherein the tabletop is mounted on two support arms which are arranged in parallel and are held via a crossmember or a transverse connection of the table frame. In this case, the support arms can be pivoted with the tabletop about a pivot axis oriented/aligned parallel to the crossmember. The pivoting mechanism is in this case mounted/arranged either on the table legs and/or on the crossmember.

Specifically, the two abovementioned documents disclose actuation of the pivoting mechanism or of a locking latch by means of a lever linkage, wherein a linear adjustment or displacement of an actuating element takes place in a longitudinal direction of the support arms. In this case, the actuation, or locking or unlocking can take place by means of a handle or a gripping rod at the end of the support arms or in a peripheral region of the tabletop, and is thus readily accessible to the user.

For example, DE 20 2007 002 775 U1 discloses a locking mechanism for locking the tabletop/support arms, wherein, for the two, fixed tabletop positions, a first locking latch and a second locking latch are provided, which are operable via a common actuating element which, as already described above, is arranged at the periphery of the tabletop for convenient operation.

In the case of such tilting tables, the crossmember has substantially static functions for absorbing loads and for spacing apart the table legs, in order to ensure the stability/rigidity of the table frame or of the whole table. This is of major importance not only in the use position but specifically also in the raised position of the tabletop and during transport, for example with rollers/wheels on the table legs. However, at the same time, the table or the table frame is intended to have as low a weight as possible and to be cost-effective, this frequently resulting in the use of tubes or section tubes for the support frame and/or the crossmember.

Furthermore, handling and quality, like convenience such as easy or smooth actuation, but also reliable locking and firm fixing of the tabletop are very important to the user, even or particularly over a relatively long useful life of the table with multiple pivoting and locking operations, i.e. over many months/years.

However, in the case of the tables that are currently common, the requirements of stability and rigidity of the table frame/table and convenience and handling for the user are specifically diametrically opposed to cost-effectiveness. Thus, such tilting tables sometimes exhibit declines with regard to the abovementioned requirements from the beginning or at least after a certain time.

OBJECT AND ADVANTAGES OF THE INVENTION

By contrast, it is the object of the invention to propose a table frame and a table which meet requirements in terms of stability, cost-effectiveness and convenience to a high degree and have in particular a long lifetime.

Proceeding from a table frame for a table of the type mentioned at the beginning, this object is achieved by the features of claim 1. Advantageous embodiments and developments of the invention are possible by way of the measures mentioned in the dependent claims.

Accordingly, a table frame, according to the invention, for a table is characterized in that the second fixing element is arranged, as a second fixing element formed separately from the base frame and/or in particular from the crossmember element and/or the support device, so as to be fixedly connectable to the base frame and/or in particular to the crossmember element and/or to the support device.

With the aid of this measure, especially the base frame, in particular the crossmember element, and/or the support device and thus the entire table frame can be produced or realized advantageously in an easy, esthetically designed and particularly cost-effective manner and at the same time, the locking or fixing of the tabletop and support arms takes place in a convenient and particularly stable, i.e. also durable, manner. Within the meaning of the invention, an advantageous structural separation of locking means/fixing means and frame/base frame is thus realized. As a result, it is possible to implement both optimization of the stability of the base frame and of the stability of the support device and optimization of the fixing or locking of the tabletop and support device separately or independently of one another. Accordingly, very high requirements of stability, cost-effectiveness, convenience and a long lifetime can be achieved in each case.

In contrast to the prior art, in which the fixing of the tabletop in the horizontal or first position takes place by means of the crossmember or the table base, according to the invention, a different, in particular more stable, more wear-resistant material and/or a particularly great thickness or wall thickness or the like can be used for the second fixing element or fixing means. By contrast, in the prior art, the fixing means or the second fixing element within the meaning of the present invention is realized for example as the comparatively thin-walled crossmember, which consists of a comparatively long rectangular tube, or as the metal sheet of the support arm. The present invention is accordingly a complete departure from this previous fixing strategy.

With a separate second fixing element according to the invention, particularly sophisticated and durable fixing of the tabletop can be realized, in particular also when a person sits down on the horizontally oriented tabletop.

Advantageously, the second and/or the first fixing element of the first fixing unit has at least one first and one second fixing surface, wherein an obtuse angle is realized between the first and the second fixing surface. In this way, advantageous multi- or two-stage fixing can be realized. This is particularly advantageous for example specifically also for the abovementioned case, namely when a person sits/stands on the horizontal tabletop, and for particularly heavy loads/strong force actions on the tabletop in the first or horizontal position.

Thus, the first stage of the fixing can be designed and dimensioned for what is known as the normal case with "normal" load or force action and advantageously, the second stage of the fixing can be designed and dimensioned for the case of a particularly heavy load with a load that goes far beyond the "normal" load or force action, such as one or even more persons sitting/standing on the tabletop. This means that the second fixing surface can be realized functionally as a securing means or an anchoring means. This increases the stability and durability and also the convenience and the impression of a particularly stable table for the user.

Preferably, the first and/or the second fixing surface is oriented at an acute angle to the longitudinal axis of the support element such that the first and/or the second fixing surface is configured as a first and/or second clamping surface. As a result, at least one or both fixing/clamping surfaces are configured for clamping or wedging, thereby realizing very stable and especially also play-free first fixing of the support device and the tabletop in the horizontal position. The lack of play of the tabletop is particularly important for the user and for the impression or the perception of the user. Thus, users consider a play-free tabletop to be a particular quality feature, i.e. as very high quality. Accordingly, the table according to the invention complies with very high quality requirements.

In a particular development of the invention, between the first fixing surface and the longitudinal axis of the support element and/or the line orthogonal/perpendicular to the pivoting movement/force action, a first angle is greater than 5°, for example about 6° up to about 12°, and additionally, between the second fixing surface and the longitudinal axis of the support element and/or the line orthogonal/perpendicular to the pivoting movement/force action, a second angle is less than 5°, for example about 4° down to about 0°. This advantageous configuration of the first fixing unit is also likewise realizable in principle with regard to the second fixing or fixing unit, however. Specifically, extensive tests have shown that this two-stage configuration of the (first) fixing or clamping is particularly advantageous.

Thus, in the first stage and by means of the first (steeper) fixing or clamping surface, firm and especially play-free fixing and also a comparatively small releasing force can be realized. This means that the support device or the tabletop is fixed/clamped in a firm and play-free manner in this first position, this being, inter alia, a high quality criterion for the user, and can also be released or unfixed or unlocked again without great effort. This is in turn a further convenience feature for the user and advantageously results in special tools for releasing the fixing not being necessary.

Furthermore, in the second stage and by means of the second (flatter) fixing or clamping surface, in the case of a very high load or very high force action, the first stage can be overloaded or yield or the fixing or the maximum holding force of the first stage/clamping can be exceeded, and then the second fixing surface/clamping surface is loaded. As a result of the comparatively flat orientation (which is even level or parallel to the longitudinal axis), a particularly high fixing/holding force of this fixing is realizable. For example, self-locking is realized, such that particularly secure and stable fixing is realized. Specifically when higher-grade plastics materials or metals, for example steel, aluminum or the like, are used, advantageous self-locking and thus force-fitting fixing is realized at an angle of less than 5°, for example about 3°. As a result, high safety requirements are complied with even under the greatest loads or force actions.

In an advantageous variant of the invention, in a first fixing position of the first fixing unit, the first fixing surface of the first fixing element is in contact with the first fixing surface of the second fixing element, and additionally, a spacing is provided between the second fixing surface of the first fixing element and the first and/or second fixing surface of the second fixing element. In this way, the multi- or two-stage configuration of the fixing is considerably improved even further. Thus, overloading or yielding of the first stage is taken into account and accepted, in order to realize a clear and effective delimitation from the second stage, or from the safety stage. The spacing apart of the second fixing surface in this case ensures advantageous releasing of the fixing in the first stage, i.e. releasing with very little force application on the part of the user.

It is only in the event of yielding or this second fixing surface coming into contact with the other fixing element or the other fixing/clamping surface that advantageous secure self-locking and/or a force fit or form fit and/or an (insurmountable) solid abutment is realized. Accordingly, in a second fixing position of the first fixing unit, the second fixing surface of the first fixing element is in contact with the first and/or second fixing surface of the second fixing element. This means that, in a second fixing position of the first fixing unit, the second fixing surface is configured as a stop or stop surface.

Preferably, the second fixing element of the first fixing unit comprises at least one recess for receiving the first fixing element, and additionally, the first fixing element of the first fixing unit is configured as a latch element for releasably locking/fixing the first fixing unit. Thus, advantageous interlocking of the two fixing elements can be realized, resulting not only in a force- and form-fitting connection/fixing, in particular transversely to the pivoting movement of the tabletop or support elements/support arms of the support device. Particularly secure and solid fixing in the first or horizontal use position is ensured as a result.

In a preferred embodiment of the invention, the first fixing surface is has a first length and/or the second fixing surface a second length, which is oriented substantially in the longitudinal direction of the longitudinal axis of the support element, wherein, advantageously, the first length and/or the second length of the first/second fixing surface is greater than a first wall width of a first wall of the crossmember element of the base frame, and/or wherein the first length and/or the second length of the first/second fixing surface is greater than a second wall width of a second wall of the support element of the support device. In this way, particularly stable and sturdy fixing can be realized, which goes far beyond fixing by means of the crossmember according to the prior art. With comparatively great material thicknesses, i.e. first and/or second lengths according to the invention, it is possible for quite large fixing/clamping forces to be realized, and it is in this way also possible to realize particularly great durability of the fixing. As a result of the great length and fixing surfaces, it is also possible for particularly little abrasion and low wear to be achieved even in the case of numerous fixing and releasing operations. Thus, high requirements are met even over a very long period of time and countless uses and pivoting operations of the tabletop.

Preferably, the actuating unit is configured to jointly actuate the first and the second fixing unit. As a result, the structural and economic outlay is reduced and additionally, the convenience for the user for actuating the two fixing units is increased.

Advantageously, the actuating unit comprises at least one spacing element, oriented substantially in the direction of the longitudinal axis, for spacing apart the first and/or the second fixing unit from an actuating element, such that the at least one spacing element is arranged between the actuating element and the first and/or the second fixing unit. In this way, spatial decoupling or separation/positioning of the actuation means or a handle or a gripping surface and of the fixing means can be realized. Preferably, the fixing means is in the middle or central region of the support device and/or tabletop and the actuation means or the gripping surface, the handle or the like is in an end region of the support device and/or of the support element and/or in a peripheral region of the tabletop. This means that the actuation takes place more toward the outside and the fixing more toward the inside or centrally. With regard to actuation, this increases the convenience and accessibility for the user.

In a particular development of the invention, the pivoting unit is fixed to the crossmember element. As a result, the base frame or the table legs/base is realizable independently of the pivoting mechanism. This allows a free and variable configuration or independent realization of the design of the base frame or of the table legs/base. Thus, a large batch size can be realized with regard to the pivoting mechanism or pivoting unit and preferably also the support device including the actuating unit, since these can be formed in an identical manner for countless tables or design variants. This improves the cost-effectiveness and the adaptability to different user interests or user desires. Thus, for example crossmember elements of different lengths for tables/tabletops of different sizes can be provided and/or advantageously, table legs or base frames that are Y-shaped, T-shaped and/or shaped/configured in a rectilinear or curved manner, with or without casters and with a square or rectangular or oval/round tabletop, etc., with a similar or identically configured pivoting mechanism/pivoting units and/or support system or support devices and/or actuating units, can be realized or combined in a freely selectable manner. This also increases the acceptance on the market.

EXEMPLARY EMBODIMENT

An exemplary embodiment of the invention is illustrated in the drawing and explained in more detail in the following text with reference to figures.

Figure 2:
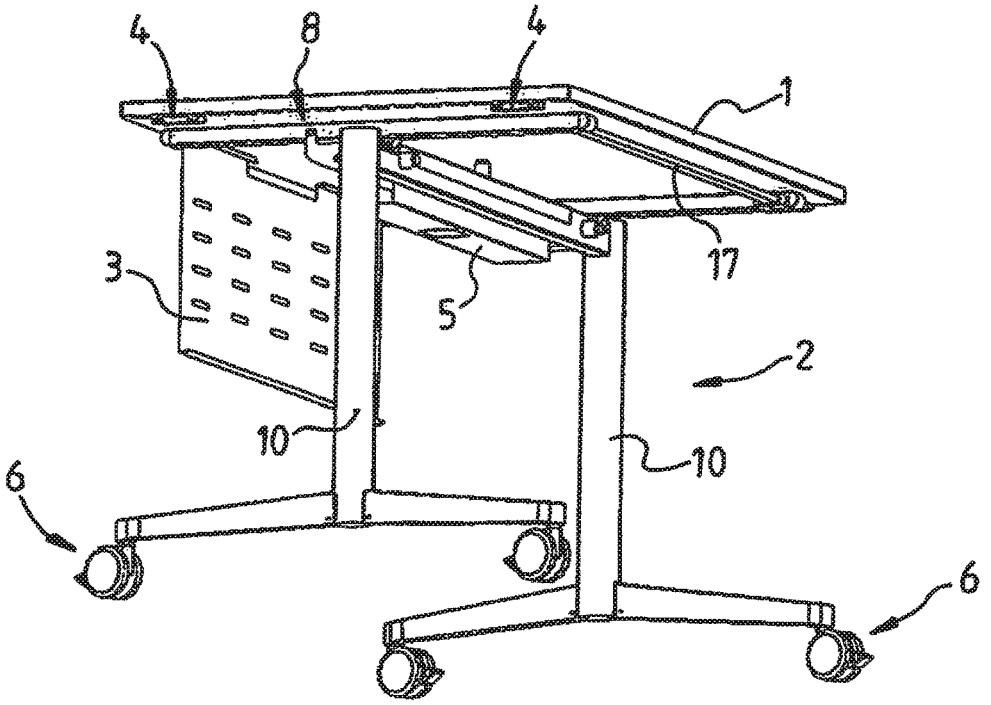
Figure 3:
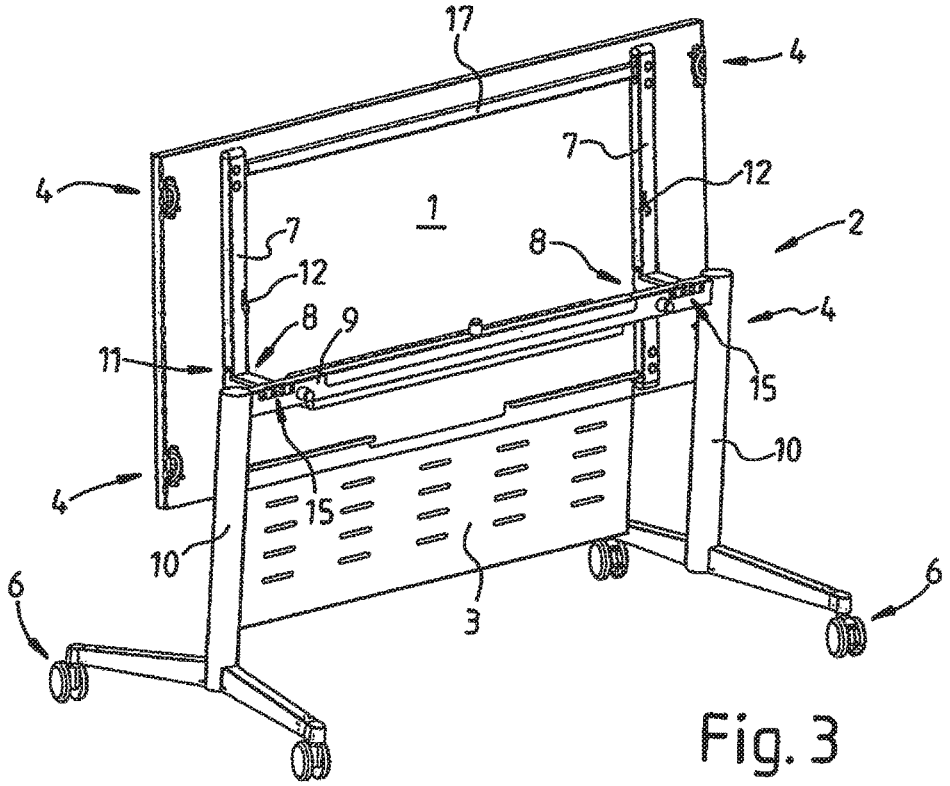
Figure 4:
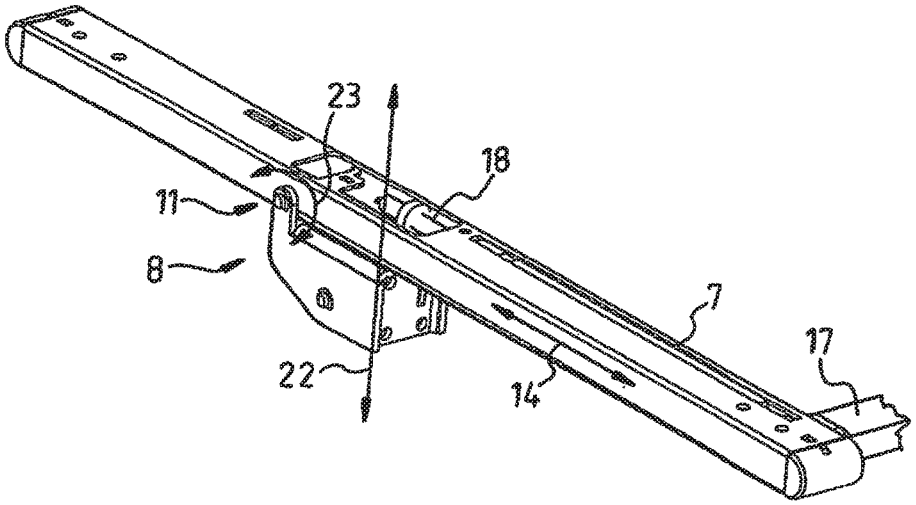
Figure 5:
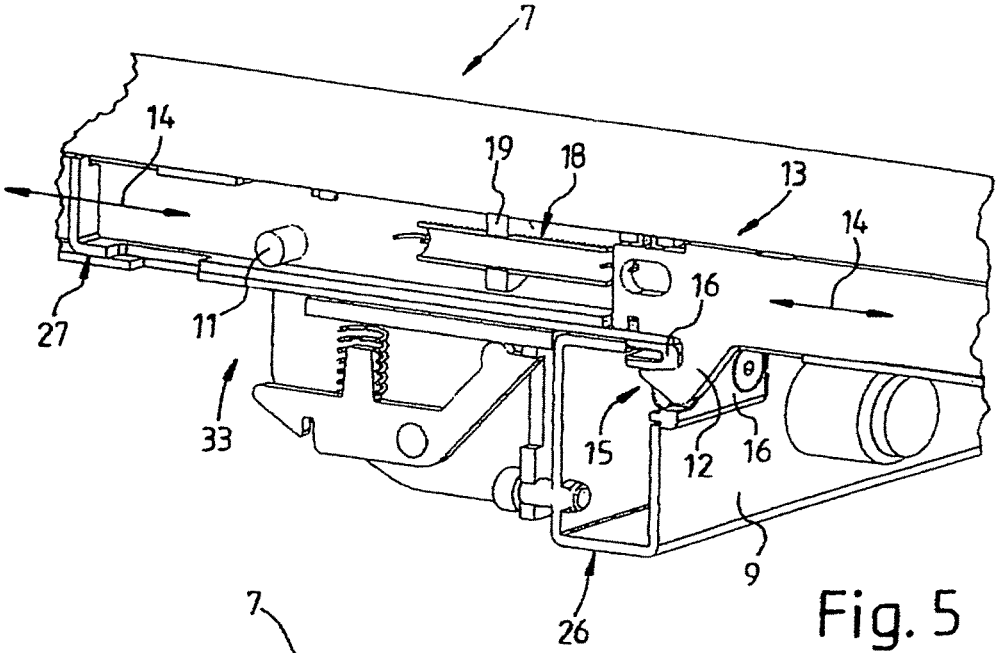
Figure 6:
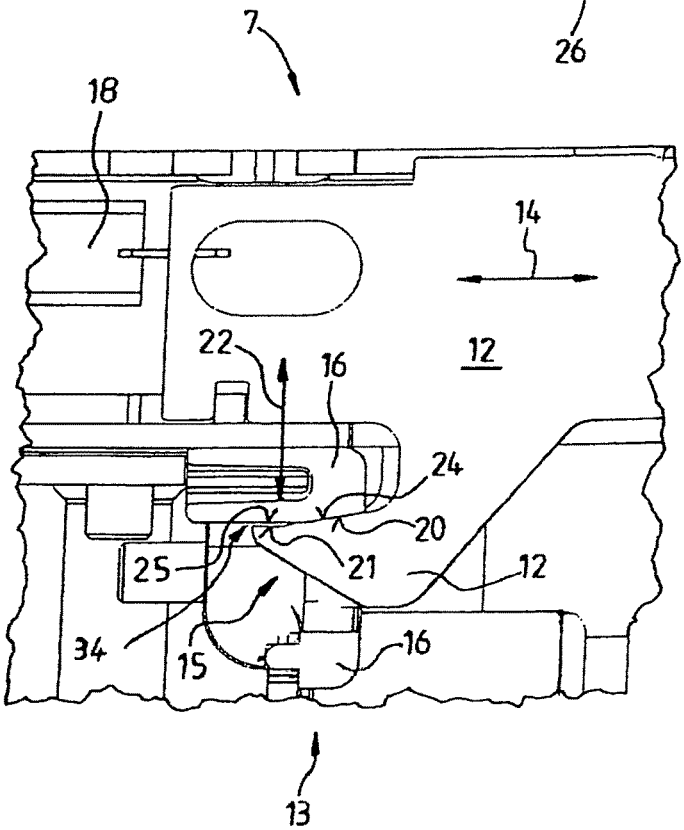
Figure 7:
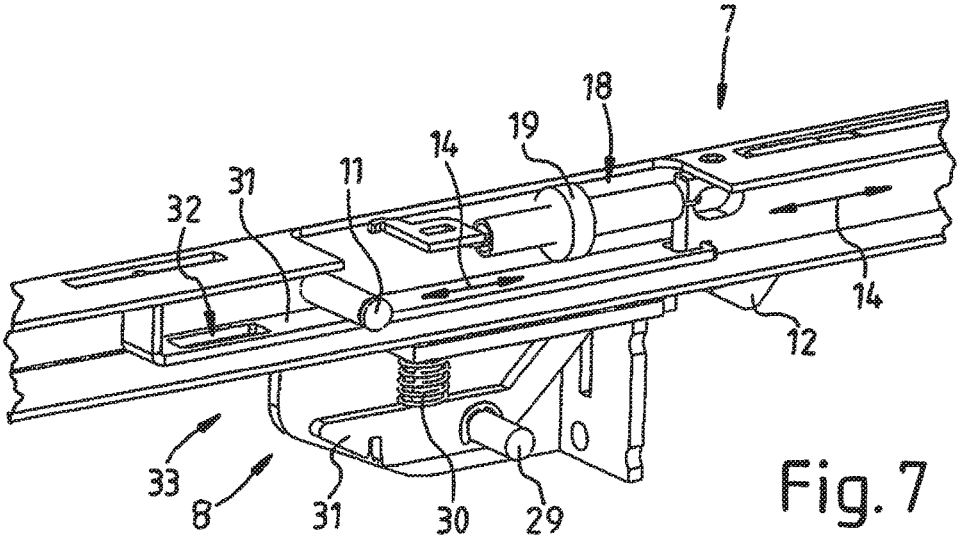
Figure 8:
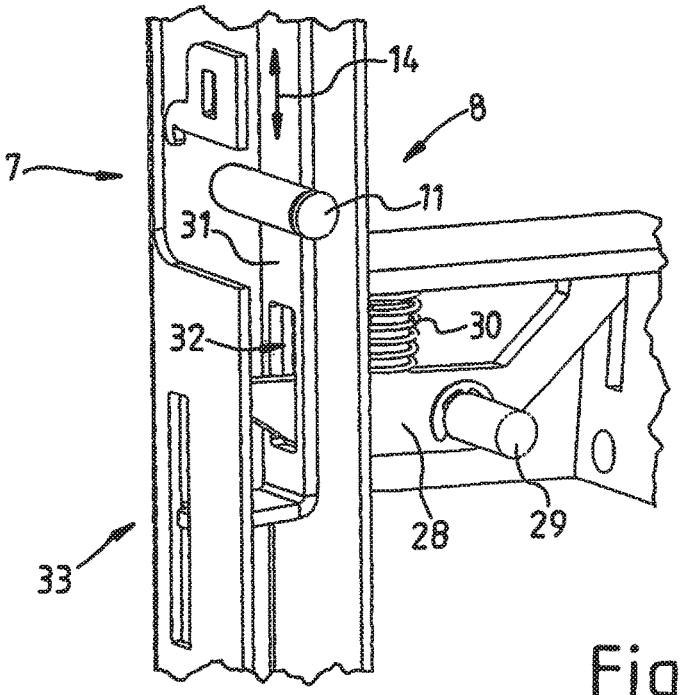

Specifically:

FIG. 1 shows a schematic, perspective view of a table according to the invention in a horizontal position, FIG. 2 shows a schematic, perspective view of a table according to FIG. 1 obliquely from below, FIG. 3 shows a schematic, perspective view of a table according to FIG. 1 in a pivoted-up position, FIG. 4 shows a schematic, perspective view of a support arm with a pivoting mechanism according to the invention in a horizontal position, FIG. 5 shows a schematic section through a support arm according to FIG. 4 with a crossmember, in the locked state, FIG. 6 shows a schematic, enlarged detail from FIG. 5, FIG. 7 shows a schematic section through a support arm according to FIG. 4 without a crossmember, and FIG. 8 shows a schematic section through a support arm with a pivoting mechanism, in a pivoted-up position according to FIG. 3 and in the locked state.

The figures illustrate a table having a tabletop 1 and a table frame 2. The variant according to FIGS. 1 to 3 additionally shows optionally usable table connectors 4, cable ducts 5, casters 6 and screens 3. The screens 3 are advantageously mounted in a rotatable manner such that they are always oriented vertically, on account of the force of gravity, in a horizontal position of the tabletop 1 (cf. FIGS. 1 and 2) and also in a raised or vertical position of the tabletop 1 (cf. FIG. 3). This is advantageous for example for conference tables and the space-saving storage thereof. The table connectors 4 allow for example tool-free linking of the tables into rows or even U shapes and L shapes.

The table frame 2 comprises substantially two similar support arms 7 which are oriented parallel to one another, are each connected via a pivoting unit 8 to a crossmember 9 oriented substantially perpendicularly or orthogonally to the support arms, and jointly support the tabletop 1.

Fixed to the crossmember 9 are two table legs 10, which are freely configurable and independent of the pivoting mechanism. In principle, within the meaning of the invention, the pivoting unit 8 could also be fixed to a table leg 10, although this would limit the free configurability of the table legs 10 or tables.

In FIGS. 1 and 2, the support arm 7, or the tabletop 1, is in a first, horizontal position, i.e. the plane of the tabletop 1 is substantially parallel to a plane defined by the casters 8 or table legs 10, such that in normal situations with a horizontal underlying surface/floor, the tabletop 1 is accordingly likewise oriented horizontally.

According to the preferred variant illustrated in the figures, the pivoting units 8 are fixed/welded to the crossmember 9. The pivoting units 8 comprise a pivot axis 11 such that the support arm 7 is pivotable about the pivot axis 11 relative to the crossmember 9 and the table legs 10. In FIG. 3, the support arm, or the tabletop 1, is in a second, raised, in particular virtually vertical or inclined/acute-angled position, i.e. the plane of the tabletop 1 is substantially vertical or at least at an acute angle, for example about 70° to about 90°, to the plane defined by the casters 8 or table legs 10. If a plurality of pivoted-up tables are pushed together, rubber elements and spacers protect the following tabletop 1.

The fixing or locking according to the invention in the first, horizontal position is illustrated especially by means of FIGS. 5 and 6. What is known as a first fixing element 12 of a first fixing unit 13 is configured as a latch 12 that is adjustable along a longitudinal axis 14 of the support arm 7 (cf. double arrow 14). This latch 12 engages in a recess 15 in what is known as a second fixing element 16.

In the present case, the latch 12 is advantageously configured at the same time, or integrally, as an actuating element or spacing element 12. As a result, a handle 17 for actuating the locking means or for actuating the fixing unit 13 arranged in the middle/central region can be arranged in a peripheral region of the tabletop 1. The spacing element 12 or latch 12 is configured as a push-pull element 1 such that, by means of a pulling force by the user, the fixing is released and the latch 12 is unlatched. An advantageous spring 18, in particular equipped with a vibration damper 19 for noise reduction, ensures reliable locking and a rest position of the latch 12 in the locking or fixing position thereof, i.e. without force action on the part of the user.

According to the invention, the second fixing element 16 is configured separately from the crossmember 9 and the base frame 2 and the table legs 10. As can be seen in FIGS. 5 and 6, the second fixing element 16 is configured as a built-in part 16 and screwed/fastened to the crossmember 9. Thus, particularly stable and play-free fixing or durable locking is realizable. Preferably, the second fixing element 16 or built-in part 16 is realized as a cast metal part 16, in particular made of steel or aluminum or the like.

The second fixing element 16 and/or the first fixing element 12, or the latch 12, advantageously each have two contact surfaces that are oriented at an angle to one another.

Thus, it is apparent from FIGS. 5 and 6 that, for example, the latch 12 comprises a first region 20, or a first contact surface 20, and a second region 21, or a second contact surface 21, oriented at an angle thereto.

The first region 20, or the first contact surface 20, is oriented at an angle of greater than 5° with respect to the longitudinal axis 14 and/or to the orthogonal line 14 with regard to the force action/direction 22 generated by the pivotability 23 in the locked/fixed position. This means that the angle between the surface 20 with respect to the longitudinal axis 14 or perpendicularly to the direction 22 is an angle greater than 5°, preferably 9° according to FIG. 6. By contrast, the angle between the surface 21 with respect to the longitudinal axis 14 or perpendicularly to the direction 22 is an angle less than 5°, preferably 3° according to FIG. 6.

Accordingly, the corresponding surfaces 24 and 25 of the second fixing element 16, or built-in part 16, are oriented in a corresponding manner, or arranged at an acute angle with respect to the longitudinal axis 14, the one at an angle of 9° and the other at an angle of 3°.

It is also clear from the figures that the lengths of the surfaces 20, 21, 24, 25, as seen in the longitudinal direction 14, are much greater than wall thickness 26 or 27, respectively, of the crossmember 9 or of the support arm 7. In the present case, they are approximately twice to four times as great/long as the wall thicknesses 26, 27 of the rectangular profile tubes, or crossmember 9 or support arms 7. Correspondingly stable and durably long-lasting is the first fixing unit 13, or the fixing of the tabletop 1 in the first, horizontal position.

As is clear especially from FIG. 6, a spacing 34, or an air gap 34, is present between the two surfaces 21 and 25, or between the latch 12 and the built-in part 16. In the illustrated first stage of the fixing, the slope of the surfaces 20, 24 ensures play-free clamping or fixing of the support arms 7 and tabletop 1. The two surfaces 21 and 25 are provided such that, in the case of a considerable or unusually heavy load on the support arms 7 or tabletop 11 in the direction 22, for example one or more persons sitting/standing on the tabletop 1, the second stage of the fixing becomes active. Thus, specifically, the latch 12 is released or adjusted somewhat/slightly with respect to the built-in part 16 (person sitting on tabletop 1 in the region of the screen 3) until the two (flat) surfaces 21, 25 come into contact or butt against one another.

As a result of the very small inclination (less than 5° with respect to the longitudinal axis 14 or with respect to the line orthogonal to the force action) of these surfaces 21, 25 and the abutment, a particularly large retaining force is also realized. This means that the tabletop 1 cannot tip. On account of the large contact surfaces and the great wall thicknesses of the second fixing element 16 and of the latch 12, no wear to or bending of these fixing elements 12, 16 is brought about, either, such that a long lifetime of the play-free fixing is realized. This means that, with the two-stage fixing or locking, a high safety requirement and a long service life are complied with, even in the event of overload.

As a result of the slope of the surfaces 20, 24 (greater than 5°, preferably 90), the locking by means of the handle 17 is very smooth, i.e. is realizable without a great deal of effort needing to be applied by the user.

The advantageous locking of the tabletop 1 and support arms 7 in the raised position, i.e. the function/operation of what is known as a second fixing unit 27, or locking unit, is apparent especially from FIGS. 7 and 8. This locking prevents any unintentional pivoting down or dropping of the tabletop 1, thereby increasing safety, in particular with regard to injuries such as trapping fingers, etc. In this case, a second latch 28 is provided, which is rotatable about an axis of rotation 29 and is positioned in a rest position or locking position by means of a spring 30. Releasing takes place in turn by means of the actuating unit, or the handle 17, and an unlocking element 31 having a recess 32. In this case, the latch 31 engages, in the fixed position, in the recess 32 and, during adjustment, is pushed in the longitudinal direction 14 from a (rear) lateral/stop surface, such that the latching of the latch 31 with the support arm 7, or the profile tube thereof, is released and the support arms 7 and the tabletop 1 can be pivoted downward into the horizontal position.

The depicted tilting table is constructed such that the tabletop 1 can be tipped downward and one or more tables can be stowed in a space-saving manner. When the table is folded/raised, the second locking mechanism 27 should also be present and always released manually for safety reasons. As a result, the tabletop 1 cannot snap downward and there is no risk of injury. Likewise, the safety means should be deliberately released when the table is intended to be flapped up.

Advantageously, one or more noise damping elements, or plastics elements, are provided such that as far as possible no or only very quiet noises arise during actuation and locking or unlocking. As a result, high requirements for low-noise operation of the table are met.

LIST OF REFERENCE SIGNS

1 Tabletop
2 Frame
3 Screen
4 Table connector
5 Cable duct
6 Caster
7 Support arm
8 Pivoting unit
9 Crossmember
10 Table leg
11 Pivot axis
12 Latch
13 Fixing unit
14 Longitudinal direction
15 Recess
16 Fixing element
17 Handle
18 Spring
19 Damper
20 Surface
21 Surface
22 Direction
23 Pivoting
24 Surface
25 Surface
26 Wall thickness
27 Wall thickness
28 Latch
29 Axis of rotation
30 Spring
31 Actuating element
32 Recess
33 Fixing unit
34 Spacing

What is claimed is:

1. A table frame comprising at least one support device to support a tabletop wherein the at least one support device has at least one support element (7) with a longitudinal axis (14) and at least one pivoting unit with at least one pivot axis (11), for pivoting the at least one support element (7) to enable the at least one support element (7) to be pivotable between a first, substantially horizontally arranged table position and a second, raised table position, and a base frame (2), having at least one crossmember element (9) oriented substantially parallel to the at least one pivot axis (11), to pivot the at least one support element (7) and at least one first fixing unit (13) for fixing the at least one support element (7) in the first, substantially horizontally arranged table position and at least one second fixing unit (33) for fixing the at least one support device (7) in a second, raised table position wherein the at least one first fixing unit (13) has at least one first fixing element that is adjustable relative to at least one second fixing element and at least one actuating unit, adjustable substantially in the direction of the longitudinal axis of the at least one support element (7), to actuate the at least one first fixing element (12) of the at least one first fixing unit (13) wherein the at least one second fixing element (16) is formed separately from the base frame (2), so as to be fixedly connectable to the base frame (2) and the at least one second or the at least one first fixing element (12, 16) of the at least one first fixing unit (13) have at least one first fixing surface and at least one second fixing surface (20, 21, 24, 25), and wherein an obtuse angle is provided between the at least one first fixing surface and the at least one second fixing surface (20, 21, 24, 25).

2. The table frame according to claim 1 wherein the at least one first or the at least one second fixing surface (20, 21, 24, 25) is oriented at an acute angle to the longitudinal axis (14) of the at least one support element (7) such that the at least one first fixing surface or the at least one second fixing surface (20, 21, 24, 25) is a clamping surface.

3. The table frame according to claim 1 wherein a first angle between the at least one first fixing surface (20, 24) and the longitudinal axis (14) of the at least one support element (7) is greater than 5°, and a second angle between the at least one second fixing surface (21, 25) and the longitudinal axis (14) of the at least one support element (7) is less than 5°.

4. The table frame according to claim 1 wherein in a first fixing position of the at least one first fixing unit (13), the at least one first fixing surface (20) of the at least one first fixing element (12) is in contact with the at least one first fixing surface (24) of the at least one second fixing element (16), and wherein a spacing (34) is provided between the at least one second fixing surface (21) of the at least one first fixing element (12) and the at least one first or at least one second fixing surface (24, 25) of the at least one second fixing element (16).

5. The table frame according to claim 1 wherein the position of the at least one first fixing unit (13), the at least one second fixing surface (21) of the at least one first fixing element (12) is in contact with the first fixing surface or the at least one second fixing surface (24, 25) of the at least one second fixing element (16).

6. The table frame according to claim 1 wherein the at least one second fixing element (16) of the at least one first fixing unit (13) has at least one recess (15) for receiving the at least one first fixing element (12), and the at least one first fixing element (12) of the first at least one fixing unit (13) is a latch element for releasably locking/fixing the at least one first fixing unit (13).

7. The table frame according to claim 1 wherein the at least one first fixing surface (20, 24) has a first length or the at least one second fixing surface (21, 25) has a second length, which is oriented substantially in the longitudinal direction of the longitudinal axis (14) to the at least one support element (7).

8. The table frame according to claim 7 wherein the first length or the second length of the at least one first fixing surface or the at least one second fixing surface (20, 21, 24, 25) is greater than a first wall width (26) of a first wall of the crossmember element (9) of the base frame (2), or the first length or the second length of the at least one first fixing surface or the at least one second fixing surface (20, 21, 24, 25) is greater than a second wall width (27) of a second wall of the at least one support element (7) of the support device.

9. The table frame according to claim 1 wherein the at least one actuating unit is configured to jointly actuate the at least one first and the at least one second fixing unit (13, 33).

10. The table frame according to claim 1 wherein the at least one actuating unit (12, 17) has at least one spacing element (12), oriented substantially in the direction of the longitudinal axis (14), for spacing apart the at least one first and/or the at least one second fixing unit (13, 33) from the at least one actuating unit (17), such that the at least one spacing element (12) is arranged between the at least one actuating unit (17) and the at least one first fixing unit or the at least one second fixing unit (13, 33).

11. The table frame according to claim 1 wherein the table has a tabletop (1) connected to the table frame (2).

12. A table frame comprising at least one support device to support a tabletop wherein the at least one support device has at least one support element (7) with a longitudinal axis (14) and at least one pivoting unit with at least one pivot axis (11), for pivoting the at least one support element (7) to enable the at least one support element (7) to be pivotable between a first, substantially horizontally arranged table position and a second, raised table position, and a base frame (2), having at least one crossmember element (9) oriented substantially parallel to the at least one pivot axis (11), to pivot the at least one support element (7) and at least one first fixing unit (13) for fixing the at least one support element (7) in the first, substantially horizontally arranged table position and at least one second fixing unit (33) for fixing the at least one support device (7) in a second, raised table position wherein the at least one first fixing unit (13) has at least one first fixing element that is adjustable relative to at least one second fixing element and at least one actuating unit adjustable substantially in the direction of the longitudinal axis of the at least one support element (7), to actuate the at least one first fixing element (12) of the at least one first fixing unit (13) wherein the at least one second fixing element (16) is formed separately from the base frame (2), wherein the at least one actuating unit has at least one spacing element, oriented substantially in the direction of the longitudinal axis (14), for spacing apart the at least one first fixing unit or the at least one second fixing unit (13, 33) from the at least one actuating unit (17), so that the at least one spacing element is arranged between the at least one actuating unit (17) and the at least one first fixing unit or the at least one second fixing unit (13, 33).

13. The table frame according to claim 12 wherein the at least one first or the at least one second fixing surface (20, 21, 24, 25) is oriented at an acute angle to the longitudinal axis (14) of the at least one support element (7) such that the at least one first fixing surface or the at least one second fixing surface (20, 21, 24, 25) is a clamping surface.

14. The table frame according to claim 12 wherein the position of the at least one first fixing unit (13), the at least one second fixing surface (21) of the at least one first fixing element (12) is in contact with the first fixing surface or the at least one second fixing surface (24, 25) of the at least one second fixing element (16).

15. The table frame according to claim 12 wherein the at least one second fixing element (16) of the at least one first fixing unit (13) has at least one recess (15) for receiving the at least one first fixing element (12), and the at least one first fixing element (12) of the first at least one fixing unit (13) and as a latch element for releasably locking/fixing the at least one first fixing unit (13).

16. A table frame apparatus comprising at least one support device to support a tabletop having at least one support element (7) with a longitudinal axis (14) and at least one pivoting unit with a pivot axis (11) to pivot the at least one support element (7) between a first, substantially horizontally arranged table position and a second, raised table position, and a base frame (2) with a crossmember element (9) oriented substantially parallel to the pivot axis (11) and at least one first fixing unit (13) having a first fixing surface and a second fixing surface with an obtuse angle provided between the first fixing surface and second fixing surface and at least one actuating unit adjustable substantially in the direction of the longitudinal axis (14) of the support element (7) with at least one spacing element disposed between the actuating unit and the at least one fixing unit.

17. The table frame apparatus according to claim 16 wherein the at least one first fixing surface or the at least one second fixing surface (20, 21, 24, 25) is oriented at an acute angle to the longitudinal axis (14) of the at least one support element (7) such that the at least one first or the at least one second fixing surface (20, 21, 24, 25) is a clamping surface.

18. The table frame apparatus according to claim 16 wherein in a first fixing position of the fixing unit (13), the second fixing surface (21) is in contact with the first fixing surface or the second fixing surface of the at least one fixing unit.

* * * * *